United States Patent [19]

Spühl

[11] 4,368,761

[45] Jan. 18, 1983

[54] CENTERING DEVICE FOR A SPRING CORE MOUNTING MACHINE

[75] Inventor: Walter Spühl, St. Gallen, Switzerland

[73] Assignee: Spühl, AG, St. Gallen, Switzerland

[21] Appl. No.: 190,042

[22] Filed: Sep. 23, 1980

[51] Int. Cl.[3] ..... B21F 21/00; B21F 45/00

[52] U.S. Cl. ..... 140/92.8; 140/92.94; 140/3 C

[58] Field of Search ..... 140/3 CA, 92.8, 92.94, 140/92.3, 92.4, 92.9; 414/751, 753, 18, 14; 294/99 R, 99 S, 100, 101

[56] References Cited

U.S. PATENT DOCUMENTS

| | | | |
|---|---|---|---|
| 2,176,262 | 10/1939 | Kirchner | 140/92.94 |
| 2,930,413 | 3/1960 | Kozak | 140/92.94 |
| 3,339,593 | 9/1967 | Krakauer et al. | 140/92.8 |
| 3,516,451 | 6/1970 | Spühl | 140/92.8 |
| 3,774,652 | 11/1973 | Sturm | 140/3 CA |
| 4,281,961 | 8/1981 | Redman | 414/751 |

*Primary Examiner*—Harold D. Whitehead
*Assistant Examiner*—Robert A. Rose
*Attorney, Agent, or Firm*—Abelman, Frayne & Rezac

[57] ABSTRACT

A centering device is provided in a spring core mounting machine having at least one pair of clamping jaws for holding together the terminal windings of adjacent helical springs while they are being connected by threading wire helices through them, with the terminal windings of the helical springs being provided at two diametrically oppositely located portions with bent-out zones in which the spring wire extends at least approximately in a straight line and in parallelism with the opposite zone. A slide is provided which is movable in axial direction and which engages the respectively newly supplied spring at its terminal winding and presses it against the movable clamping jaw.

5 Claims, 6 Drawing Figures

CENTERING DEVICE FOR A SPRING CORE MOUNTING MACHINE

BACKGROUND OF THE INVENTION

The present invention relates to a centering device for centering adjacent helical springs, and more particularly to a centering device for a spring core mounting machine.

Spring core mounting machines are used to construct the inner spring cores for inner spring mattresses and spring supports for mattresses. These spring cores have a large number of springs of helical configuration which are mounted side by side, with the terminal windings of the springs at the upper and lower ends thereof being connected, usually by threading a small helical connecting spring around portions of two adjacent ones of the helical support springs.

A spring core mounting machine for making spring cores of the type here in question is described in German Patent Number 1,552,149 and in the thereto corresponding U.S. Pat. No. 3,516,451. This machine uses support springs which do not have the bent-out portions in their terminal convolutions. In many instances, the helical support springs which are used to make up the spring core have in their terminal windings two diametrically oppositely located portions at which they are bent out, with these portions extending approximately in a straight line and parallel to one another. Helical springs with such bent out portions or zones are already known as "offset springs".

The centering device according to the present invention is intended to be used with this type of machine, i.e. to make it possible to use in this type of machine the so called offset springs having the bent-out portions in their terminal convolutions. To be able to use this type of spring in this type of machine, it is necessary to center the individual springs on insertion thereof into the associated pair of clamping jaws provided for holding the springs, i.e. to so orient these springs that the bent-out portions of the terminal convolutions of adjacent springs which are to be connected with one another are located precisely opposite one another and in abutment or almost in abutment.

SUMMARY OF THE INVENTION

It is therefore the general object of the present invention to provide a centering device for use in the aforementioned spring core mounting machine, which allows the spring core mounting machine to be used with offset springs.

A more particular object of the invention is to provide a centering device for use with the aforementioned spring core mounting machine which assures that offset springs are automatically centered prior to the connection of their terminal convolutions by means of connecting helixes.

In keeping with these objects, and with others which will become apparent hereafter, one feature of the invention resides in a centering device for centering adjacent helical springs during connection of their terminal convolutions in a machine for making inner-spring cores, the terminal convolutions each having two diametrically opposite bent-out sections and the machine including at least one set composed of a stationary jaw and a movable jaw movable toward and away from the stationary jaw in a path, and at least one slide reciprocable in said path and having a surface engageable with a terminal convolution of a respective newly supplied spring for pressing it against the movable jaw. Briefly stated, such a centering device may comprise a centering recess in the aforementioned surface adapted to center the respective terminal convolution and including a depression shaped to receive a bent-out portion; and a spring-biased hook portion at a leading end of the slide engageable with a respective terminal convolution for drawing the same in the aforementioned path away from the movable jaw and towards the stationary jaw, each of the jaws having a centering recess for a respective one of the bent-out portions.

By resorting to the device according to the present invention, a first centering is effected during the advancement of the slide by the centering phase of the same, whereas a subsequent or final centering is effected, if necessary, during pushing of the spring into the stationary jaw.

The invention will hereafter be described with reference to the embodiment as shown in the appended drawing. It is to be understood, however, that the drawing is one embodiment only and that it is not to be considered limiting of the invention.

DESCRIPTION OF PREFERRED EMBODIMENTS

Figure 1:
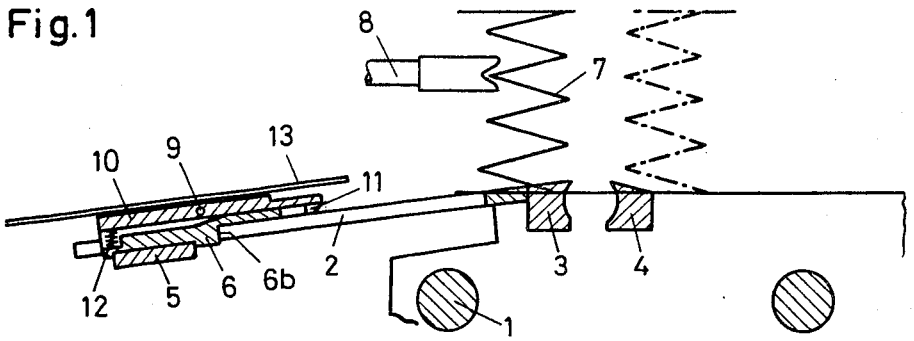
FIG. 1 is a side view, illustrating in a somewhat diagrammatic partly sectioned manner those parts of the centering device and spring core mounting machine which are necessary for an understanding of the invention.

Referring to the drawing in detail it should first be understood that the details of the spring core mounting machine with which the centering device according to the present invention is to be used, are disclosed in the aforementioned German Patent 1,552,149 and the thereto corresponding U.S. Pat. No. 3,516,451, the latter being incorporated herewith by reference.

Figure 2:
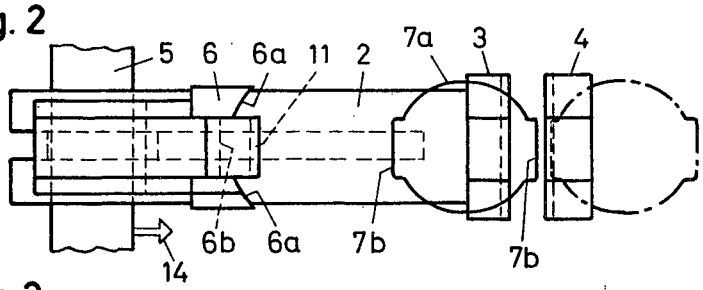
FIG. 2 is a top-plan view of FIG. 1.
Figure 4:
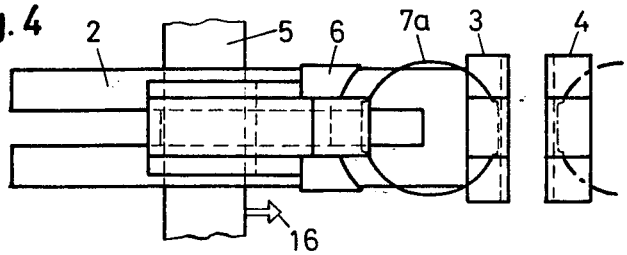
FIG. 4 is a view similar to FIG. 3, illustrating still a further operating position.
Figure 4A:
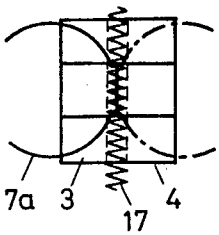
FIG. 4*a* is a detailed view, seen from the top, showing adjacent terminal sections of two springs being connected by a connecting helix.
Figure 5:
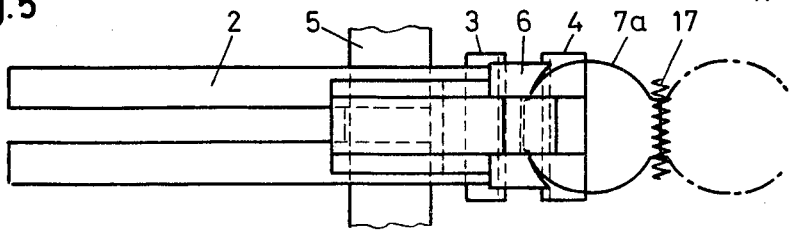
FIG. 5 is a view similar to FIG. 4 showing still an additional operating position.

With this in mind, it will be seen that FIGS. 1 and 2 show only a stationarily mounted transverse bar 1 on which a support or carrier is secured to which a stationary clamping jaw 3 is mounted. A second clamping jaw 4, movable by not illustrated means which are known per se into and out of the open position of FIGS. 1–2 from the closed position shown in FIG. 4*a*, is also carried by the support 2.

A slide 6 is mounted on a traverse 5 and is shiftable lengthwise of the support 2. It will be understood, of course, that although the drawing shows only a single set of jaws 3,4 and a single slide 6, an entire series of sets of jaws and of slides will be provided which are arrayed next to each other (i.e. in a row behind the ones shown in FIG. 1) and which are all operated at the same time so as to be able to produce a spring core. However, it is not necessary for an understanding of the invention to show all these various elements, and therefore they have been omitted.

FIG. 2 shows best the configuration of the upper and lower terminal windings of the so called offset springs 7, i.e. the inner springs which are to make up the spring core. The terminal windings of these springs 7 each are provided at two diametrically opposite locations with bent-out portions 7*b* in which the wire of the spring extends in a straight line or at least approximately in a straight line, with the portions 7*b* at opposite sides of the convolution extending in parallelism with one another. In these portions 7*b*, the terminal windings (at the upper and at the lower ends) of two adjacent springs 7 are connected in known manner by threading a wire helix 17 through them (compare FIG. 4*a*).

The springs 7 are placed between the open clamping jaws 3,4 in approximately centered position, either by hand or by the pivot arm 8 of a transfer machine. In order to obtain an exact centering, the following measures are provided according to the present invention:

The slide 6 is provided at its surface cooperating with the terminal windings 7*a*, 7*b* with a surface which is inwardly curved at 6*a* and provided with a recess 6*b* for the portion 7*b*, this surface acting as a centering surface. In addition, the slide 6 is provided with a lever 10 which is pivotable about a horizontal axis 9 and which has at its front end a pull-back hook 11; the other end of the lever 10 is biased by a spring 12 to tilt about the axis 9 so that the hook 11 is always urged in clockwise direction (FIG. 1), i.e. is always urged to its operating or effective position. The slide 6 with the lever 10 is covered by a cover sheet 13.

Figure 3:
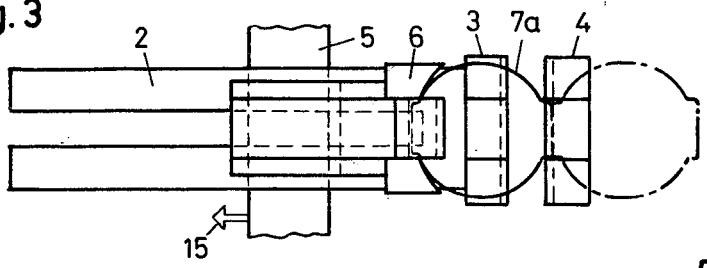
FIG. 3 is a view similar to FIG. 2 but illustrating the machine in a different operating position.

As illustrated by the arrow 14 in FIG. 2, the slide 6 performs a (forward) movement to the position shown in FIG. 3, causing the terminal convolution 7*a* to be pressed against the terminal convolution 7*a* of the preceding spring in the clamping jaw 4. The curved contour 6*a* of the surface of slide 6 causes the terminal convolution 7*a* to be centered during this movement and at the same time the hook 11 snaps over and engages the terminal convolution in the portion 7*b*. Thereupon the slide 6 moves in the opposite direction, as indicated by the arrow 15 in FIG. 3, and the hook 11 now pulls the terminal convolution 7*a* into the position shown in FIG. 4 so that it enters into the depression provided for it in the stationary clamping jaw 3, obtaining an additional centering effect thereby.

Now, the movable clamping jaw 4 is moved to closed position, as shown in FIG. 4*a* and in known manner a wire helix is threaded about the portions 7*b*, 7*b* of the two adjacent springs 7, connecting the terminal convolutions 7*a* of the two adjacent springs 7. The clamping jaw 4 is then opened again (FIG. 4) and the connected zone of the two terminal convolutions is lifted in known manner. The slide 6 then performs a further movement in the direction of the arrow 16 as shown in FIG. 4, whereby the still free second bent-out portion 7*b* of the terminal convolution 7*a* is moved into the opened clamping jaw 4, and thereupon the hook 11 is released in any convenient manner and the slide 6 is returned to its position shown in FIG. 2, so that a new working sequence can begin, in which a new spring is moved to the position of FIGS. 1 and 2.

The invention has been described hereinbefore with reference to an exemplary embodiment and is illustrated in the drawing. It is to be understood, however, that this is only to facilitate an understanding of the invention and that the scope of protection sought is defined exclusively in the appended claims.

I claim:

1. A feeding device for springs having opposite offset portions and for use in feeding such springs to a spring core fabricating machine:

said device including a guide immovably positioned relative to a fixed jaw of said machine;

a slide movable longitudinally of said guide;

a gripping device carried by said slide and operative to grip an offset portion of one of said springs; and, drive means for sequentially moving said slide and the supported gripping device in opposite directions longitudinally of said guides, whereby said springs are selectively movable in forward and reverse directions relatively to said jaws.

2. The feeding device of claim 1, in which said slide includes a recess of a shape complementary to that of one of said offset portions of said springs, and said gripping device is operative to position and immovably hold a said offset portion within said recess in correct orientation relatively thereto.

3. The feeding device of claim 2, in which said gripping device is a resiliently biased latch pivotally mounted on said slide, said latch having a camming surface permitting it to ride over a said offset portion, and having a gripping surface precluding unintended release of a gripped said offset portion from within said recess.

4. A method of feeding offset springs to a spring core mounting and winding machine, comprising the steps of:

feeding said springs to said machine with the offset portions thereof approximately oriented relatively to the clamping jaws of said machine;

feeding said springs forwardly to position one of said offset portions within said jaws and in abutting contact with an offset of a spring previously located within and positioned by one of said jaws, said forward feeding movement further orienting the offsets of said springs;

gripping the other offset of said portions in a manner further orienting the offset portions of said springs;

reversely moving said gripped springs to position said one offset portion thereof within the other of said jaws, and to still further correctly orient said offset portions;

immovably holding said gripped springs during closing of said clamping jaws and the coil winding thereof by said machine to maintain said offset portions in correct orientation during said winding operation;

opening said clamping jaws and removing the wound and interconnected offset portions from within said jaws;

feeding said gripped offset portions forwardly into said one gripping jaw; and, releasing and depositing said gripped offset portion within said one gripping jaw in correctly oriented position relatively thereto.

5. In a machine for mounting and winding springs of a spring core, and which includes a device for feeding springs to clamping jaws of said machine, means for opening and closing said clamping jaws to mount said springs, and means for winding a helical coil through said jaws to secure the clamped portions of the springs to each other:

the improvement comprising feeding means adapting said machine to the mounting and winding of springs having opposite substantially straight offset portions, said feeding means being comprised by;

a slide movable in a direction lateral to the opening of said jaws and lateral to the longitudinal axis of winding of said helical springs;

guides supporting said slide for said movement, said guides being fixed in position relative to a fixed jaw of said machine;

a gripping device carried by said slide and operative to grip an offset portion of said spring; and, drive means for sequentially moving said slide in a first forward direction towards said jaws to bring one of said offset portions of said spring into abutment with a movable jaw of said clamping jaws, and for the gripping device then to grip the other of said offset portions;

in a second, opposite direction to bring said gripped spring into abutment with the fixed jaw of said clamping jaws and then to hold said spring immovable relatively to said fixed clamping jaw;

in a third, forward, direction to release the gripped spring from said fixed clamping jaw upon completion of the winding of said helical coil and the opening of said jaws, and then to deposit the gripped offset portion in said movable jaw and release said gripped offset portion; and, in a fourth, opposite direction to release said spring and return said slide to its initial position for the reception of the next spring in a series of such springs.

* * * * *